US007084755B1

(12) United States Patent
Nord

(10) Patent No.: US 7,084,755 B1
(45) Date of Patent: Aug. 1, 2006

(54) METHOD AND DEVICE FOR MONITORING THE REGION OF TECHNICAL ROLLING BODIES

(76) Inventor: Klaus-Jurgen Nord, Friedrichstrasse 81, Mannheim (DE), D-68155

( * ) Notice: Subject to any disclaimer, the term of this patent is extended or adjusted under 35 U.S.C. 154(b) by 926 days.

(21) Appl. No.: 09/655,462

(22) Filed: Sep. 5, 2000

Related U.S. Application Data

(63) Continuation-in-part of application No. PCT/DE99/00597, filed on Mar. 5, 1999.

(30) Foreign Application Priority Data

Mar. 5, 1998 (DE) ..... 198 09 970

(51) Int. Cl.
*G08B 1/08* (2006.01)

(52) U.S. Cl. ..... 340/539.1; 340/425.5; 340/429; 340/438; 340/440; 340/671; 340/672; 340/676

(58) Field of Classification Search ..... 340/425.5, 340/429, 440, 438, 671, 672, 676, 539.1
See application file for complete search history.

(56) References Cited

U.S. PATENT DOCUMENTS 4,710,977 A 12/1987 Lemelson
5,346,163 A 9/1994 Momma et al.
5,431,054 A 7/1995 Reeves et al.
5,614,670 A 3/1997 Nazarian et al.
5,948,027 A * 9/1999 Oliver et al. ..... 701/37
6,086,254 A * 7/2000 Lyon ..... 384/12
6,378,382 B1 * 4/2002 Noguchi et al. ..... 73/862.29

FOREIGN PATENT DOCUMENTS

| | | |
|---|---|---|
| DE | 1936592 | 1/1970 |
| DE | 3407641 | 10/1984 |
| DE | 4335776 | 5/1994 |
| EP | 0493146 | 7/1992 |
| WO | 8700562 | 1/1987 |

* cited by examiner

*Primary Examiner*—Daryl Pope
(74) *Attorney, Agent, or Firm*—Horst M. Kasper

(57) ABSTRACT

The invention relates to a method for monitoring the area of technical rolling bodies, especially their supports, wherein the forces exerted in that area are detected with sensors in order to generate electrical energy and to detect changes in the state of the area. At least one of the sensors (2, 3, 4) arranged in the area of the technical rolling bodies is actively impinged upon with electrical energy and introduces impulses that can be evaluated in the support (1) of the sensor (2, 3, 4) working as actuator. Thus, impulses that can be evaluated can be detected at any given time by the sensors (2, 3, 4) in the area (1) of the technical rolling bodies during monitoring with an electrical evaluation unit.

13 Claims, 3 Drawing Sheets

METHOD AND DEVICE FOR MONITORING THE REGION OF TECHNICAL ROLLING BODIES

CROSS-REFERENCE TO RELATED APPLICATIONS

Figure 1:
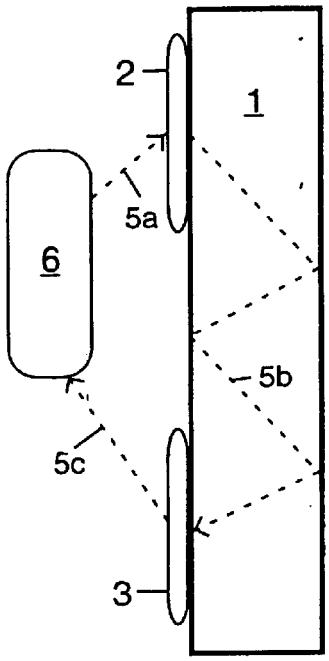

This application is a continuation-in-part application of another international application filed under the Patent Cooperation Treaty on Mar. 5, 1999, bearing Application No. PCT/DE99/00597, and listing the United States as a designated and/or elected country. The entire disclosure of this latter application, including the drawings thereof, is hereby incorporated in this application as if fully set forth herein.

TECHNICAL FIELD

The invention relates to a method for monitoring the region of technical rolling bodies, in particular their supports, such as rails of a wheel rail system or bearings, by employing converters, wherein the converters are disposed at the support or at the rolling body, capture forces exerted in the support or at the rolling body, generate electrical pulses and signalize the electrical pulses to an electrical control and evaluation station, wherein changes in state of the monitored region, such as material or separation damages, are detected with the electrical pulses, according to the preamble of claim 1 as well as a device for this purpose according to the preamble of claim 5.

Such a method for the generation of electrical energy in the region of moving technical rolling bodies is known from the German printed patent document DE 4335776, wherein the inelastic deformations causing the rolling friction and the thereby occurring forces in the region of the bearing or, respectively, roll off points of the rolling body are periodically transferred to electromechanical converters and are transformed thereby at least in part into electrical energy. The pulses initiated by rolling off of the rolling bodies in their region are captured with sensors disposed there in order to generate therewith electrical energy and in order to detect generally changes of state. Similarly the device serves for the monitoring of technical rolling bodies with a control and evaluation device for technical apparatus, wherein the roll off properties of the technical rolling bodies are derived from the electrical energy, such that corresponding safety steps can be taken in case of occurring deviations of this electrical energy. The electromechanical converters are disposed in the operating regions of the periodically changing roll friction forces of technical rolling bodies and/or of their supports in an apparatus for generation of electrical energy at rolling technical bodies, wherein the rolling technical bodies are permanently monitorable by way of a control device. The forces are transferred onto converters and are thereby transformed into electrical energy, wherein the rolling off properties of technical rolling bodies are derived from this electrical energy, additionally or by itself, and wherein the rolling off properties can be controlled thereby at the corresponding device.

A method and a device for determining the adhesion coefficient relationships between vehicle tire and road track has become known furthermore from the German printed patent document DE-A1-3937966. At least one sensor is disposed in the tire protector, which sensor captures the courses of the local tensions or, respectively, strains or, respectively, deformations in horizontal direction and in perpendicular direction upon passing through the tire contact area. The measurement signals of the sensor are transferred to an evaluation device. Both the required adhesion coefficient parameter as well as the maximum possible adhesion coefficient parameter between the vehicle tire and the road track is determined there from the measurement signals. Roll friction forces are not measured with this method.

A method for determining the friction torque of a measurement bearing is known from the German print patent document DE 3536474 C2, wherein a bearing ring of the measurement bearing is rotated with a constant rotation speed, while the other bearing ring is connected to a spring operating as a force transducer through a measurement head, wherein the force transducer generates a signal to the measurement for the friction torque of the measurement bearing and wherein the force transducer damps the motion of the measurement head force transducer system as little as possible. The measurement bearing is replaced by an air bearing for calibrating of the measurement device wherein a signal proportional to the spring deformations and a signal proportional to the measurement head acceleration are generated in connection with this air bearing arrangement and wherein a further signal is therefrom derived. In the following the obtained signals are summed up in connection with the friction torque measurement of the measurement bearing, wherein the result represents a measure of the occurring friction torque.

TECHNICAL OBJECT

The invention is based on the purpose to further develop such a method and such a device of the recited kind such that state changes occurring in the range of the technical rolling bodies can be detected at any time with sensors.

DISCLOSURE OF THE INVENTION AND OF ITS ADVANTAGES

The object is accomplished with a method of the initially recited kind in accordance with the present invention by applying electrical energy to a converter disposed at the support in the monitored region of the technical rolling body or at least disposed at the technical rolling body and wherein the converter introduces evaluable pulses into the support or into the rolling body as a pulse emitter, which pulses are captured by at least one of the converters, wherein pulses are emitted from the converter in turn, which pulses are captured by the control and evaluation device as evaluable pulses, and thereby the region of the technical rolling body is monitored at any time relative to changes of state.

Thus the region of the technical rolling bodies, in particular the support, for example a rail, can be monitored at any time relative to changes of state in an advantageous way.

It is furnished in accordance with the invention method that at least one of the sensors operating in the region of the technical rolling body as a converter is subjected to electrical energy and thereby introduces evaluable pulses as an actor sensor into the support of the sensor, such that at any time evaluable electrical pulses can be captured with the further sensors disposed in the region of the technical rolling body, wherein changes of state can be read from the evaluation of the electrical pulses and whereby this region can be monitored at any time. The supply of the actor sensor with electrical energy can be performed with an arbitrary energy source, wherein the energy source is activated for example by a control and evaluation station.

The introduction of the pulses into the region of the technical rolling bodies is accomplished by having an actor of the converter operating as a pulse emitter and activated with electrical energy introducing evaluable pulses, for example mechanical waves into the support of the converter, for example a rail and wherein at any time the pulses can be captured with converters disposed in the region of the technical rolling bodies. Thus changes in state as material damages and separation damages can be detected and signalized at any time in the region of the technical rolling bodies with the sensors.

Electromechanical converters are employed here as actor sensors, which capture pulses at the support of the converters and which converters when subjected to electrical energy generate corresponding pulses, for example elastic waves at the support as actor sensors or, respectively, generators or, respectively, are capable of signalizing such pulses from there in a complimentary way. The distances and the powers of the sensors operating as actors or, respectively, as converters depend on the distances to be overcome, or, respectively, the required intensities for transmission of the pulses at/in the support of the sensors and can be determined in advance.

In principle converters of the same construction or of different construction as well as pulse receivers as well as pulse emitters can be operated at distances in the region of the technical rolling bodies and can thereby initiate at any time mechanical or, respectively, electromagnetic waves in the support of the actor sensors. All effective powers or, respectively, transmissions of the necessary input, output and test signals from or, respectively, toward the actor sensors or, respectively, the converters can be performed in a conventional way for example by way of galvanic elements such as cables and the like and/or at least in part wireless, thereby the mounting of conventional transmission elements can be dispensed with. For example piezo sensors are proposed as converter sensors, wherein the oscillation moved parts of the piezo sensors contact the support of technical rolling bodies as actors upon the respective stroke reversal or, respectively, operate a pulse hammer.

A device according to the present invention for monitoring the region of technical rolling bodies, in particular the supports of the technical rolling bodies such as rails of a wheel rail system or bearings, with converters, which are disposed at the support or at the rolling body, which device captures forces occurring in the rolling bodies, which device generates electrical pulses and signalizes these electrical pulses with electrical control and evaluation station, wherein by way of the control and evaluation station changes in state of the monitored region, such as material damages and separating damages, are detected, such device is characterized in that at the one converter disposed at the support in the monitored region of the technical rolling body or at least disposed at the technical rolling body is actively subjectable with electrical energy and introduces thereby evaluable pulses as a pulse emitter into the support, which pulses can be captured by at least one of the converters as a pulse receiver as evaluable pulses and are signalizable from there to the control and evaluation station as electrical pulses.

The advantages obtainable with the present invention comprise that the region of technical rolling bodies can be monitored relative to material damages and separating damages at any time reliably and at low cost according to the method and this holds in particular for vehicle rails for high-speed railways. The pulses introduced with the actor sensors operating as part sensors can be formed relative to a known set value previously determined, for example by measurement. In case of a deviation of the arriving actual value of the pulses at the sensors operating as pulse receivers relative to the known value, this allows to make conclusions relative to the extent of the damages occurred or, respectively, there starting damages in the region of the support of the technical rolling bodies, and in fact at any time in case of a control measurement prior to consequences of damages and independent of the motion of the rolling body.

The evaluation of mechanical or, respectively, electromagnetic pulses of such actor sensors (converter systems) toward the control and evaluation station, which control and evaluation station can operate stationery or, respectively, mobile as such, is performed by way of suitable arrangements for this purpose and can be performed radio controlled, by way of an oscilloscope or, respectively, controlled by a computer. It is known that in particular piezo electric sensors can operate reciprocally as actor and as sensor, and for this reason this is not considered here in detail. All converter systems are to be understood to be actor sensors, wherein the oscillation moved parts of the converter systems can operate as actors, for example as pulse hammer, or, respectively, wherein the oscillation moving parts can immediately drive such a pulse hammer and wherein the oscillation moved parts in addition or by itself capture evaluable pulses (forces) at their support or, respectively, can signalize or, respectively, are capable of working by pulse echo.

Figure 2:
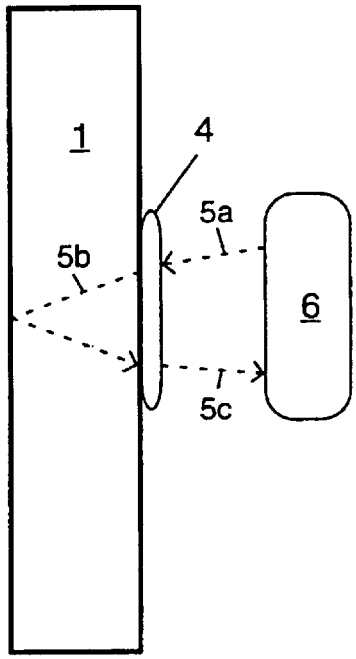
Figure 3:
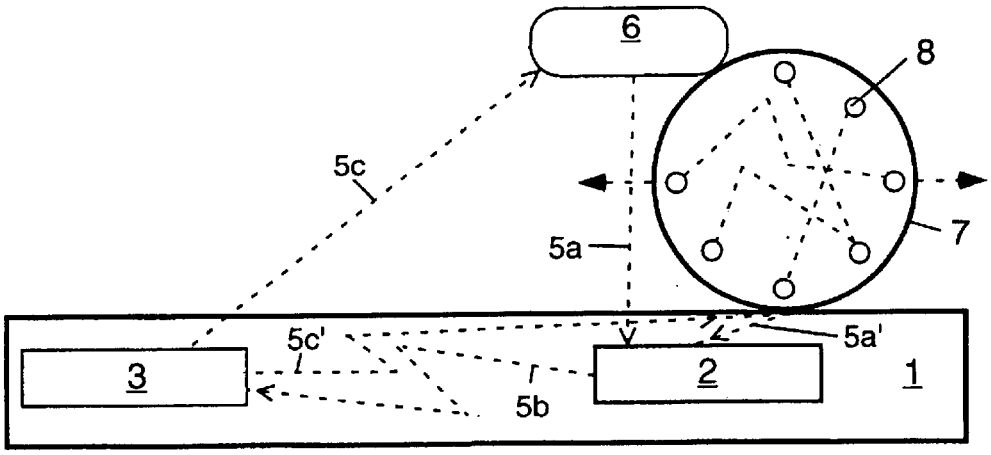

Short description of the drawing, where there is shown:

FIG. 1 the extended and stretched support as a region of a technical rolling body in a top planar view with the sensor disposed at the support, FIG. 2 the extended and stretched support as a region of a technical rolling body in a top planar view with an operating actor sensor disposed at the support 1 as a module, and FIG. 3 a further extended and stretched support in a side elevational view, where a technical rolling body 7 moves on the extended and stretched support, and FIGS. 4 through 7 individual representations of the functioning of technical rolling bodies and their supports, which are summarized by way of a drawing in FIG. 3.

Paths for performing the invention:

FIG. 1 shows an extended and stretched support 1, such as rail 1, as a region of a technical rolling body (not shown) in a top planar view, with a sensor 2 disposed at the support 1 and operating as an actor, such as pulse emitter —pulse receiver 2 or, respectively, converter 2, which is subjected to electrical energy 5*a* by a control and evaluation station 6. The converter 2 guides thereby physically evaluable pulses 5*b* into the support 1, wherein the physically evaluable pulses 5*b* are captured by a sensor 3 operating also as a converter, such as test signal receiver 3 or pulse emitter—pulse receiver 3, at or, respectively, in this support 1 and wherein the physically evaluable pulses are signalized from there as electrical signals 5*c* to a control and evaluation station, for example by galvanic coupling or by way of a radio connection. The receiving control and evaluation station can be identical with the control and evaluation station 6. The converter 2 and the converter 3 can also be built by the same construction.

FIG. 2 shows an extended and stretched support 1, such as rail 1 as a region of a technical rolling body (not shown) in a top planar view with an actor sensor 4 or converter 4 disposed at the support 1 and working as a module, wherein the actor sensor 4 or converter 4 is subjected by a control and evaluation station to electrical energy 5*a* and which actor sensor 4 or converter 4 introduces pulses 5*b* to the support 1 as an emitter and which simultaneously captures all receivable pulses 5*b* at the support 1 as a receiver and which actor sensor 4 or converter 4 transfers the receivable pulses 5*b* as electrical signals 5*c* to a control and evaluation station, wherein the receiving control and evaluation station in turn can be identical with the emitting control and evaluation station 6.

FIG. 3 shows an extended and stretched support 1, such as rail length 1, where a technical rolling body 7, such as a vehicle wheel moves on the rail length 1 in a side elevational view, wherein pulse emitter 8, such as test signal sensors 8, are disposed preferably peripherally at the rail length 1. Electrical energy in the shape of pulses 5*a* can be supplied to a pulse emitter—pulse receiver 2 or, respectively, converter 2 disposed at or, respectively in the support 1 by a control and evaluation station 6, wherein the control and evaluation station 6 is connected to the rolling body 7 and for example is supported by the rolling body 7, wherein the pulse emitter—pulse receiver 2 or, respectively, converter 2 in turn introduces pulses 5*b* into the support 1, wherein the pulses are guided to a further converter 3 disposed at or, respectively in the support 1, wherein the pulses 5*b* are received by the converter 3 and are transferred as electrical signals 5*c* to the control and evaluation station 6. The converter 2 and the converter 3 can again be constructed in the same way.

Similarly it is possible that signals from the control and evaluation station 6 are delivered to the test signal sensors 8 within the rolling body 7; for example the control and evaluation station 6 guides electrical energy into the test signal sensors 8, which test signal sensors 8 in turn introduce evaluable pulses 5*a'* to the converter 2, wherein the converter 2 in turn emits signals 5*b*, wherein the signals 5*b* expand and propagate in the support 1 and are received by the converter 3 and are directed either directly as a signals 5*c* to the control and evaluation station 6 or as the signal 5*c'* to the test signal sensors 8, wherein the test signal sensors 8 in turn further guide or, respectively, transmit the signals to the control and evaluation station 6. The pulses can be transmitted wireless here from or, respectively, to the control and evaluation station 6, wherein the stationery control and evaluation 6 or, respectively, also a mobile control and evaluation station can be operated at least in part by radio transmission technology.

In principal, the pulses of the converter 2, which are introduced by the converter 2 after its excitation into the support 1, are detected by the converter 3 after passing through of the pulses over a defined length at or, respectively, in the support 1 and the pulses can be signalized from there or, respectively from the converter 3 to a stationery or, respectively, mobile control and evaluation station 6.

In the same way the pulse emitter 8 subjected to electrical energy 5 by the control and evaluation station 6 can generate pulses at the support 1, wherein the pulses can be transmitted and evaluated by the converter 2, 3 and wherein the pulses in turn can also be received by the pulse emitters 8 and can be further guided to the control and evaluation station 6.

Figure 4:
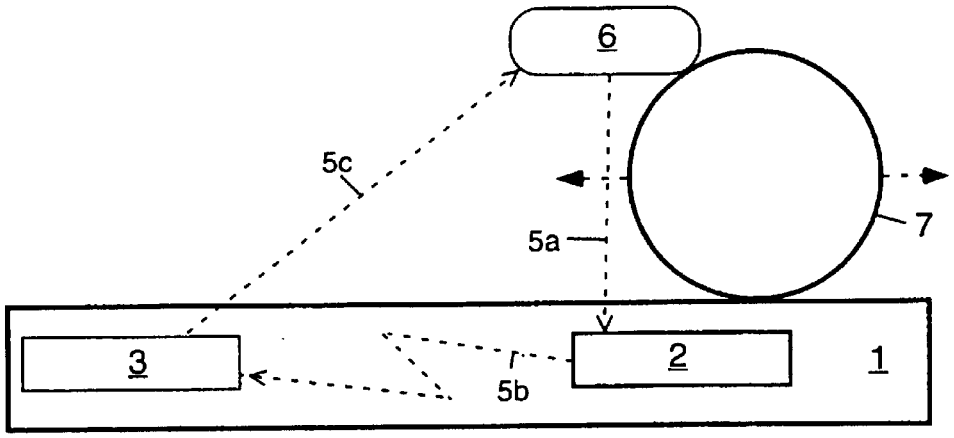

FIG. 4 shows an extended and stretched support 1, such as rail length 1, where a technical rolling body 7 in a side elevational view, such as a vehicle wheel 7 on the rail length 1. Electrical energy in the form of pulses 5*a* can be delivered by a control and evaluation station 6, which is in connection with the rolling body 7 and for example which is carried by the rolling body 7, to a pulse emitter—pulse receiver 2 disposed at or, respectively in the support 1, wherein the pulse emitter—pulse receiver 2 is an electromagnetic converter 2, wherein the electromagnetic converter 2 in turn feeds pulses 5*b* into the support 1, wherein the pulses 5*b* are guided to a further converter 3 disposed at or, respectively, in the support 1, wherein the pulses 5*b* are received by the converter 3 and are transmitted to the control and evaluation station 6 as electrical signals 5*c*. Converter 2 and converter 3 can again be constructed in the same way.

Figure 5:
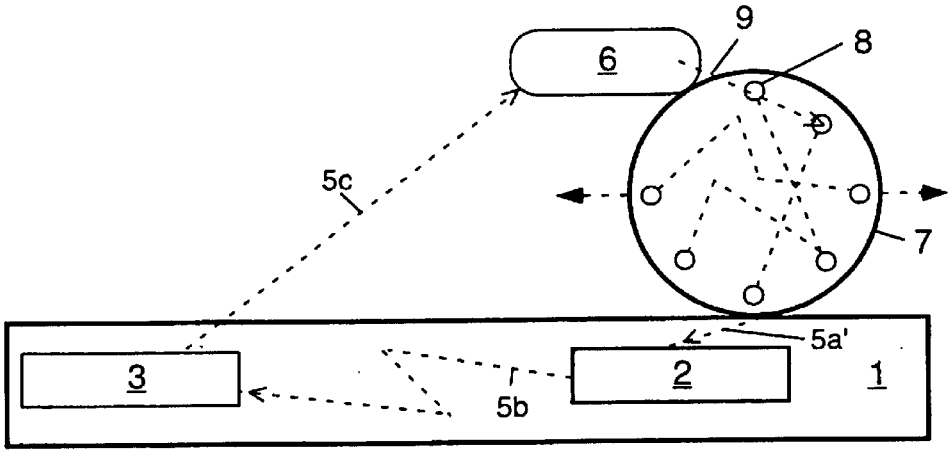

FIG. 5 shows an extended and stretched support 1, such as rail length 1, wherein a technical rolling body 7 in side elevational view, such as vehicle wheel 7, moves on the rail length 1. Signals 9, which are emitted by the control and evaluation station 6, are delivered to test signal sensors 8 disposed within the rolling body 7; for example the control and evaluation station 6 guides electrical energy 9 into the test signal sensors 8, wherein the test signal sensors 8 in turn feed evaluable pulses 5*a'* to the converter 2 disposed at or, respectively in the support 1, wherein the converter 2 in turn emits signals 5*b*, which signals 5*b* expand and propagate in the support 1 and which signals 5*b* are received by the converter 3 disposed in or, respectively at support 1 and wherein the signals 5*b* are guided or, respectively, transmitted directly to the control and evaluation station 6 as the signals 5*c*. Converters 2 and 3 as well as the test signal sensors 8 can be of the same construction.

Here the pulses can be transferred wireless from or, respectively, to the control and evaluation 6. The control and evaluation station 6 can be a stationery or also a mobile control and evaluation station 6. Similarly the control and evaluation station can at least in part be operated by radio transmission technology.

Figure 6:
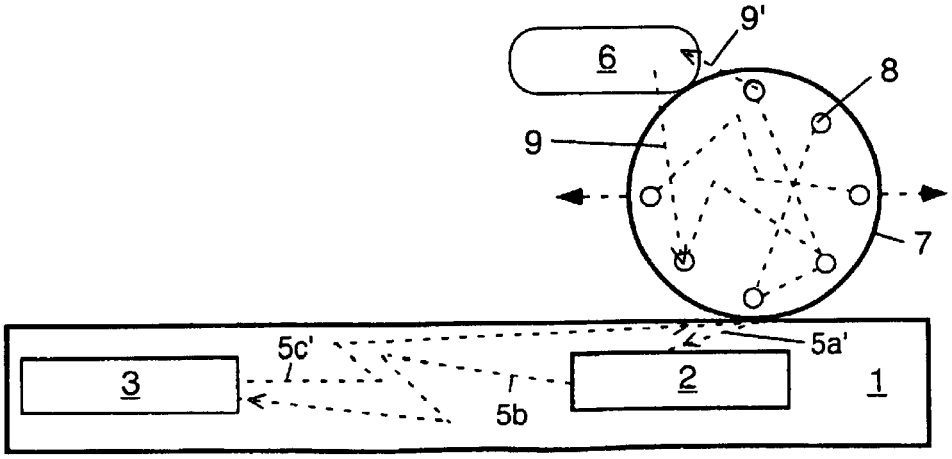

FIG. 6 shows an extended and stretched support 1, such as rail length 1, wherein a technical rolling body 7 in a side elevational view, such as vehicle wheel 7 moves on the rail length 1. Signals 9, which are emitted by the control and evaluation station 6 are delivered to test signal sensors 8 or, respectively, converters 8 disposed inside of the rolling body 7; for example the control and evaluation station 6 feeds electrical energy 9 into the converters 8, which converters 8 in turn introduce evaluable pulses 5*a'* into the converter 2, wherein the converter 2 in turn emits signals 5*b*, which signals 5*b* expand and propagate in the support 1 and are received by the converter 3 and are delivered as signals 5*c'* to the converter 8 within the rolling body 7, wherein the converters 8 in turn further feed or, respectively, transmit these signals 9' to the control and evaluation station 6. The pulses 9, 9' can be transmitted wireless here from or, respectively, to the control and evaluation station 6. The control and evaluation station 6 can be a stationery or also a mobile control and evaluation station 6 again in this case, and similarly the control and evaluation station can be operated at least in part by radio transmission technology. The test signal sensors 8 are similarly electromagnetic converters and can be constructed like the electromagnetic converter 2,3,4 and can be exchangeable with the electromagnetic converter 2,3,4.

Figure 7:
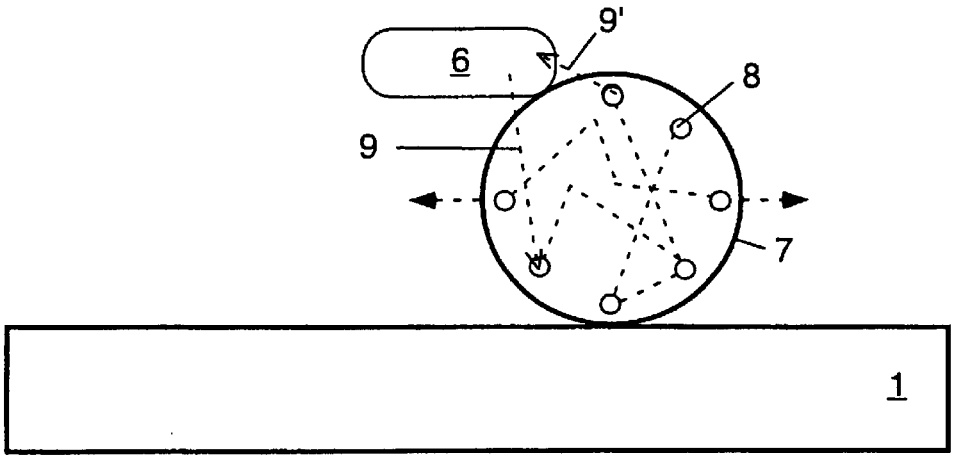

Similarly FIG. 7 shows an extended and stretched support 1, such as rail length 1, wherein a technical rolling body 7 in side elevational view, such as vehicle wheel 7, moves on the rail length 1, wherein the vehicle wheel 7 supports the control and evaluation station 6. The control and evaluation station 6 emits electrical pulses 9 to electromechanical converters 8 of the technical rolling body 7, which electro mechanical converters 8 operate as pulse receivers in this manner. The converters 8 now in turn send evaluable pulses as pulse emitters into the technical rolling body 7, which evaluable pulses are in the same measure received by the converters 8 and are further guided and are transmitted to the control and evaluation station 6 as electrical pulses 9'. This embodiment just can serve alone for the monitoring of the vehicle wheel.

It is to be noted for the further illustration of the present invention that if deformations, which are generated in the rolling body or in the support or in both caused through the rolling off of the rolling body on the support, are to be employed in order to be converted into electrical energy, then this is possible by the application of suitable electromagnetic converters either in or at the rolling body or in or at the support or both at the rolling body as well as at the support. The energy gained in this manner is characteristic for the state of the system components rolling body/support. The same holds for the change of this energy. Thus in a reversible conclusion a statement about the system state can be derived from the obtained energy. Rolling body and support preferably are made out of metal.

If such a monitored and necessarily in motion presented system for monitoring is to be surveyed in the same measure in a rest state, then it is offered to reverse the converters already present in the system in their mode of functioning or, respectively, their mode of working, that is the function of the energy or, respectively, the receiving of the force out of the system with following conversion into electrical energy is reverse such that the introduction of electrical energy in one or several of the converters—independent of the positioning of the converters—leads to a delivery of energy to the system, which energy then is read out again at a different or at the same location out of the system. By comparing the fed in energy relative to the delivered energy it is possible to make statements about the system state also in the rest state of this system.

Such a system is then at any time in motion to monitor at least one of the parts of the rolling body, which becomes possible without further energy feed in by gaining the energy from the motion and the property as an electromechanical converter. The basic equipment for the second step of the invention is the reversal of the direction of work of individual converters by energy subjection (as a substitute for the energy previously gained from the motion), whereby the motion of the system is also possible in a rest state for gaining comparable statements relative to the system.

The invention is commercially applicable in particular in the region of technical rolling bodies, such as bearings, rollers, etc., in particular at their supports and here in particular at the extended and stretched supports of wheel rail systems, wherein the wheel vehicle itself can be the control and evaluation station. Similarly the invention is also applicable at rail systems not directly bound to earth for the monitoring of rails for elevated railways and suspended railways.

What is claimed is:

1. Method for monitoring the region (1,7) of technical rolling bodies (7), in particular their support (1) such as rails of the wheel rail systems or bearings, by employing of converters (2,3,4,8) which are disposed at the support (1) or at the rolling bodies (7), which converters (2,3,4,8) capture forces occurring in the support (1) or at the rolling body (7), wherein the converters (2,3,4,8) generate electrical pulses and signalize the electrical pulses to an electrical control and evaluation station (6), wherein changes in state of the monitored region, such as material damages or separating damages, are detected by way of the electrical pulses, characterized in that at least one of the electrical converters (2,3,4,8) disposed at the support (1) in the monitored region (1,7) of the technical rolling body (7) or at least at the technical rolling body (7) is subjected actively with electrical energy (5*a*,9) and thereby the converter (2,3,4,8) feeds evaluable pulses (5*a*′, 5*b*, 5*c*′) into the support (1) or the rolling body (7), which pulses (5*a*′, 5*b*, 5*c*′) are captured by at least one of the converters (2,3,4,8), wherein pulses (5*a*′, 5*b*, 5*c*′) in turn are emitted by at least one of the converters (2,3,4,8), which pulses are captured by the control and evaluation device (6) as evaluable pulses (5*c*, 9'), and whereby the region (1,7) of the technical rolling bodies (7) is monitored at any time relative to changes in state.

2. Method according to claim 1, characterized in that the converter (2,3,4,8) corresponds wireless with the control and evaluation station (6), for example by radio transmission technology.

3. Method according to claim 1 or 2, characterized in that the converters (2,3,4,8) are such, which feed either mechanical or electromagnetic waves into the support (1).

4. Method according to claim 1, characterized in that the converters (2,3,4,8) operating as pulse emitters are supplied with electrical energy by the electrical control and evaluation station (6).

5. Device for monitoring the region (1,7) of technical rolling bodies (7), in particular their supports (1) such as rails of a wheel rail system or bearings, with converters (2,3,4,8), wherein the converters are disposed at the support (1) or at the rolling body (7), and wherein the converters (2,3,4,8) capture forces occurring in the support (1) or at the rolling body (7), wherein the converters (2,3,4,8) generate electrical pulses and signalize these electrical pulses to an electrical control and evaluation station (6), wherein changes of state of the monitored region, such as material damages and separation damages, are detected with the control and evaluation station (6), characterized in that at least one of the converters (2,3,4,8) disposed at the support (1) in the monitored region (1,7) of the technical rolling body (7) or at least one of the converters (2,3,4,8) disposed at the rolling body (7) actively is subjectable to electrical energy (5*a*,9) and thereby feeds evaluable pulses (5*a*′, 5*b*, 5*c*′) into the support (1) as a pulse emitter, which pulses (5*a*′, 5*b*, 5*c*′) are capturable by at least one of the converters (2,3,4,8) as a pulse receiver and are signalizable from there as electrical pulses (5*c*, 9') to the control and evaluation station (6).

6. Device according to claim 5, characterized in that the radio transmission technology device is coordinated to at least one of the converters (2,3,4,8), wherein the radio transmission technology device corresponds wireless with the control and evaluation station (6).

7. Device according to claim 5 or 6, characterized in that the converters (2,3,4,8) are of such kind that they are capable of either introducing mechanical or electromagnetic waves into the support (1).

8. Device according to claim 7, characterized in that the electrical control and evaluation station (6) supplies the converters (2,3,4,8) operating as pulse emitters with electrical energy.

9. Device according to claim 8, characterized in that the support is a rail (1) and the technical rolling body is a vehicle wheel (7), wherein converters (2,3,4,8) are disposed at the rail and at the vehicle wheel (7) as pulse emitters, wherein the converters (2,3,4,8) generate pulses at the support (1), which pulses are received by the converters (2,3,4,8) as pulse receivers and are transmitted and again received from the converters (8) disposed at the vehicle wheel (7) and are further guided to the control and evaluation station (6).

10. Device according to claim 8, characterized in that the support is a rail (1) and the technical rolling body is a vehicle wheel (7), wherein converters (8) are disposed at the vehicle wheel (7) as pulse emitters, which converters generate pulses at the vehicle wheel (7), which pulses are received by the converters (8) disposed at the vehicle wheel (7) and are transmitted and are further guided to the control and evaluation station (6).

11. Device according to claim 9, characterized in that the control and evaluation station (6) is supported by the vehicle wheel (7).

12. A method for monitoring comprising the steps of:

employing converters (2,3,4,8);

disposing the converters (2,3,4,8) at the support (1) or at the rolling bodies (7);

capturing forces occurring in the support (1) or at the rolling body (7) with the converters (2,3,4,8);

generating electrical pulses in the converters (2,3,4,8);

subjecting actively at least one of the electrical converters (2,3,4,8) disposed at the support (1) in the monitored region (1,7) of the technical rolling body (7) or at least at the technical rolling body (7) with electrical energy (5*a*,9);

signalizing electrical pulses from the converters (2,3,4,8) to an electrical control and evaluation station (6);

detecting changes in state of the monitored region including material damages or separating damages by way of the electrical pulses;

feeding evaluable pulses (5*a*′, 5*b*, 5*c*′) from the converter (2, 3, 4, 8) into the support (1) or the rolling body (7), which pulses (5*a*′, 5*b*, 5*c*′) are captured by at least one of the converters (2,3,4,8), wherein pulses (5*a*′, 5*b*, 5*c*′) in turn are emitted by at least one of the converters (2,3,4,8);

capturing the pulses (5*a*′, 5*b*, 5*c*′) by the control and evaluation device (6) as evaluable pulses (5*c*, 9') for monitoring the region (1,7) of the technical rolling bodies (7) at any time relative to changes in state Monitoring the region (1, 7) of the technical rolling bodies (7) in connection with rails of a wheel rail system or of a bearing.

13. The method according to claim 12 further comprising transmitting by wireless radio transmission between the converter (2,3,4,8) and the control and evaluation station (6).

* * * * *